United States Patent [19]

Kulesza et al.

[11] Patent Number: 4,579,541

[45] Date of Patent: Apr. 1, 1986

[54] MECHANICAL ACTION MONSTER ROCK TOYS

[75] Inventors: Ralph J. Kulesza, Chicago; Dennis R. Gibbons, Hometown; Harry Disko, South Barrington, all of Ill.

[73] Assignee: Marvin Glass & Associates, Chicago, Ill.

[21] Appl. No.: 699,830

[22] Filed: Feb. 8, 1985

[51] Int. Cl.[4] ..... A63H 3/24; A63H 3/36

[52] U.S. Cl. ..... 446/304; 446/301; 446/339; 446/365; 272/8 R

[58] Field of Search ..... 446/304, 337–340, 446/330, 320, 300, 301, 395, 289, 268, 359, 365, 368, 321, 352, 353, 309; 272/8 R, 8 N

[56] References Cited

U.S. PATENT DOCUMENTS

| | | | |
|---|---|---|---|
| 753,335 | 3/1904 | Ward | 446/309 |
| 2,802,301 | 8/1957 | Lohr | 446/304 |
| 4,424,978 | 1/1984 | Kassai | 446/337 X |

*Primary Examiner*—Mickey Yu

*Attorney, Agent, or Firm*—John S. Pacocha

[57] ABSTRACT

Toy monster rocks have a base with a substantially flat bottom. One or more pieces are mounted for pivotal movement with respect to the base. Movement of the piece or pieces from a quiescent position to an aggressive position exposes an open mouth. An actuator effects such movement. In some embodiments the spring urges the pivotal movement against the restraint of a latch disengagable by a trigger part of the actuator. Gears are used to move pieces in other embodiments.

10 Claims, 24 Drawing Figures

MECHANICAL ACTION MONSTER ROCK TOYS

BACKGROUND OF THE INVENTION

1. Field of the Invention

This invention relates generally to mechanical action toys and more particularly to toys that have articulated parts providing for reconfiguration of the toy and a mechanical action.

2. Background Art

Mechanical action toys have long been popular playthings. More recently, toys that are reconfigurable either by dismantling and reassembling component parts or by rearrangement of self-contained parts have become popular. Examples of such reconfigurable prior art toys are found in U.S. Pat. Nos. 4,183,173; 4,214,402; 4,248,006 and 4,382,347. One example of a mechanical action toy is found in U.S. Pat. No. 4,244,138 and another in U.S. Pat. No. 4,307,533. There remains, however, a need for additional toys that are reconfigurable, particularly in a surprising manner, and have a mechanical action to enhance play.

SUMMARY OF THE INVENTION

The present invention is concerned with providing toys having articulated portions permitting a surprising reconfiguration of the toy as well as a mechanical action of the toy in one of the reconfigured states. These and other objects and advantages of the invention are achieved by providing toys with pivotally connected parts that come together to create an outer, rocklike appearance. Parts of each rock open to transform it into a creature having a mechanical animated action.

BRIEF DESCRIPTION OF THE DRAWINGS

For a better understanding of the present invention reference may be had to the accompanying drawings in which.

DETAILED DESCRIPTION OF THE PREFERRED EMBODIMENT

Figure 1:
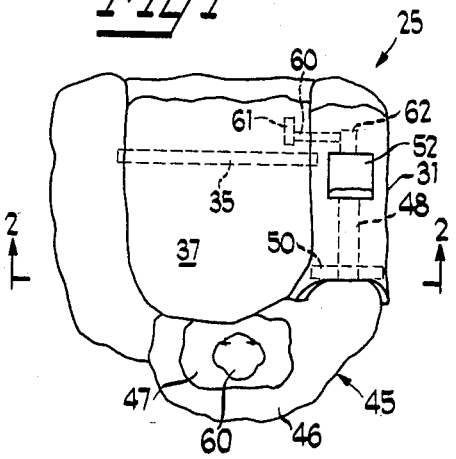
FIG. 1 is a top plan view of one embodiment of the present invention.

Referring now to the drawings in which like parts are designated by like reference numerals throughout the several views, there is shown in FIG. 1 a monster rock toy 25 having a base piece 27 with a generally flat bottom 28. Base 27 includes an integral upwardly projecting shoulder portion 29. Part of base 27 forms a hollow ledge 31 spaced from and generally parallel to shoulder portion 29. A generally central depression 33 is formed between shoulder 29 and ledge 31. All of the exposed surfaces of base 27 and ledge 31 have an appearance and texture simulating a rock.

Figure 5:
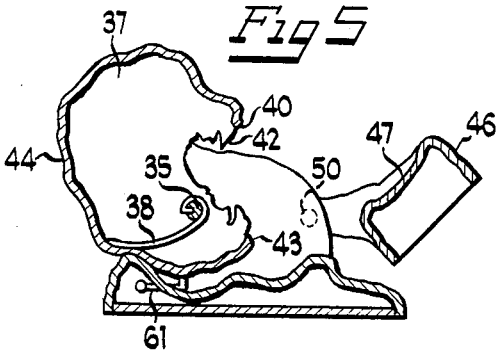
FIG. 5 is a sectional view along a line similar to line 3—3 of FIG. 2 during actuation.
Figure 2:
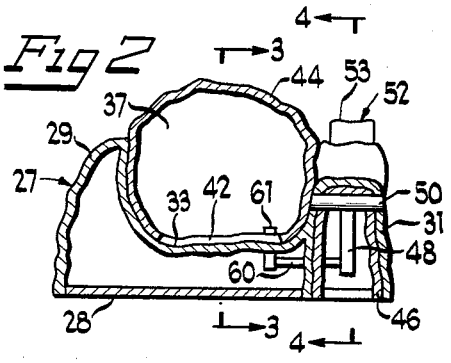
FIG. 2 is a sectional view taken generally along line 2—2 of FIG. 1.

Nested in depression 33 for pivotal movement about a shaft 35 secured between shoulder 29 and ledge 31 is a hollow boulder piece 37 having opposed faces on either side of the shaft. Attached at one end to the shaft is a flat leaf spring 38 that bears against the inside of boulder 37. Thus, the boulder is biased into the position shown in FIG. 5 exposing face 40 which has a monsterlike appearance with a gaping fanged mouth 42 including a lower lip 43. When the boulder is rotated back against the bias of the spring into the quiescent state of monster rock 25 illustrated in FIG. 3, face 40 is hidden in the depression 33 and opposed face 44 is exposed. The surface of face 44 has a rocklike appearance and texture conforming with that of the exposed surfaces of base 27 and ledge 31.

Projecting outwardly through an opening in one end of ledge 31 and extending across the front of the monster rock 25 is a roughly L-shaped piece 45. One leg of piece 45 is exposed and extends across the front of monster rock 25 forming an armlike shelf 46. As with the exposed surfaces of base 27, ledge 31 and face 44, the exposed surfaces of shelf 46 have a compatible rocklike appearance and texture. In the upper surface of the shelf there is a substantially flat depressed area 47 generally centrally disposed with respect to the front of the monster rock. The other leg 48 of piece 45 extends into hollow ledge 31.

Adjacent the junction of leg 48 and ledge 31, piece 45 is mounted for pivotal movement about a pin 50 journaled in ledge 31. Extending upwardly from approximately the midpoint of leg 48 is an actuator button 52, the top 53 of which has a rocklike appearance. Actuator 52 is received for sliding movement in a sleeve 55 in the upper part of ledge 31 with the top 53 exposed. Beyond actuator 52, leg 48 continues rearwardly and downwardly forming spaced apart fingers 57 and 58.

A rod 60 is mounted for rotation in the inner wall of base 27 adjacent ledge 31. The rod has a radial hook latch 62 adjacent one end and an approximately forty-five degree offset release lever 62 adjacent the other end. Both latch 61 and lever 62 rotate with rod 60. Latch 61 engages lower lip 43 maintaining boulder piece 37 in the quiescent position against the bias of spring 38 with the rocklike face 44 exposed to view. Lever 62 is accommodated for pivotal movement in the space between fingers 57 and 58.

Figure 3:
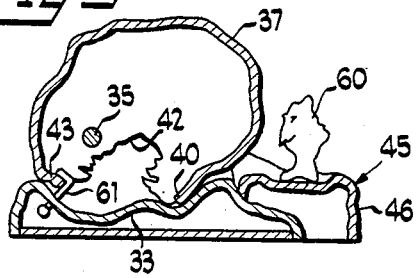
FIG. 3 is a sectional view taken generally along line 3—3 of FIG. 2.

Depression of actuator button 52 moves finger 57 down against lever 62 and rotates latch 61 out of engagement with lip 43 permitting boulder 37 to be pivoted around by the spring 38 to expose the open mouth of aggressive monster face 40. At the same time, depression of actuator button 52 pivots the armlike shelf 46 about the axis of pin 50 upwardly toward open mouth 42. Thus, if an object such as character 60 illustrated in FIG. 3 is positioned upon the shallow, generally flat depression 47, character 60 will be flipped into the open mouth of the monster rock. In order to return the monster to its quiescent rock state, boulder 37 is pushed back down against the bias of the spring to hide monster face 40 in depression 33 and arm 46 is pushed back down bringing up actuator 52 with finger 58 pivoting up lever 62. Upward rotation of the lever also brings latch 61 back up into engagement with lower lip 43 to again retain boulder 37 against the bias of spring 38.

An alternative of the present invention is shown in FIGS. 6–11 embodied in a monster rock toy 65. There is a hollow base piece 67 having a generally flat bottom 68. On the front of base 67 there is a monster face 70 with an open fanged mouth 72. Attached for pivotal movement toward and away from monster face 70 are a pair of arm ledges 74 and 75. Each of the arm ledges is mounted for pivotal movement about a shaft 77 which has a gear 78 secured for rotation with the shaft.

Gear 78 engages an intermediate gear 80 on a shaft 81 which in turn engages a larger drive gear 82 mounted for rotation on a shaft 83. Between the two gears is a sliding actuator 85 having a rack 86 on each opposed edge of the elongated actuator meshing with one of the gears 82. Because of the ratio of the gears, limited linear movement of sliding actuator 85 results in greater angular movement of shafts 77. Thus, it will be appreciated, particularly from the illustration of FIG. 11, that as the actuator 85 is pushed toward the front of base 67 both of the arm ledges 74 and 75 will be pivoted away from the monster face and as the actuator is moved rearwardly the shoulder ledges will pivot back to a closed position.

At the back end, actuator 85 is formed with an enlarged rim 88 exposed outside of base 67 when the actuator is in its forwardmost position. Rim 88 serves as a stop to limit the forward movement of the actuator. Rearward movement of the actuator is limited by the laterally projecting back teeth on the racks 86. The forward end 89 of the actuator may be styled to simulate a tongue in the fanged mouth 72.

Figure 6:
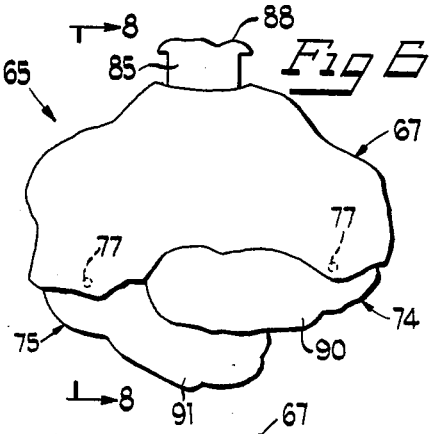
FIG. 6 is a top plan view of an alternative embodiment of the present invention.
Figure 7:
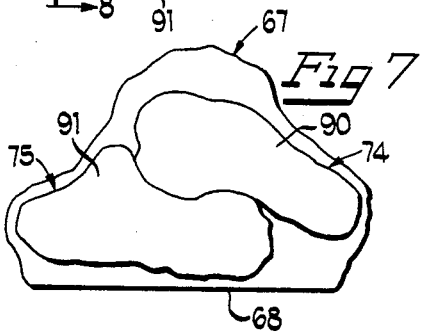
FIG. 7 is a front elevational view of the alternative embodiment.
Figure 4:
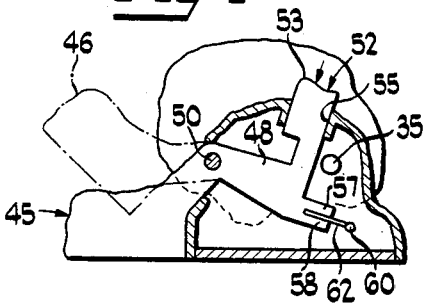
FIG. 4 is a sectional view taken generally along line 4—4 of FIG. 2.
Figure 8:
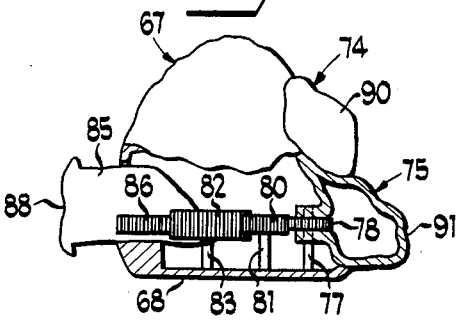
FIG. 8 is a sectional view taken generally along line 8—8 of FIG. 6.
Figure 9:
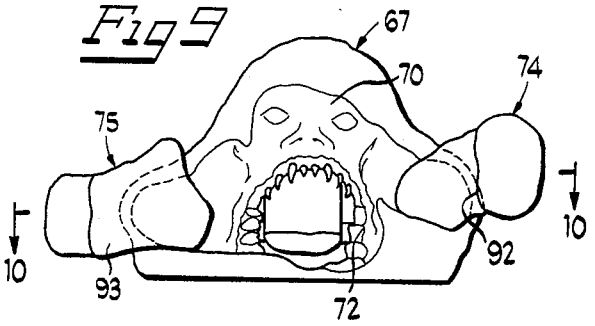
FIG. 9 is a front elevational view of the alternative embodiment when actuated.
Figure 11:
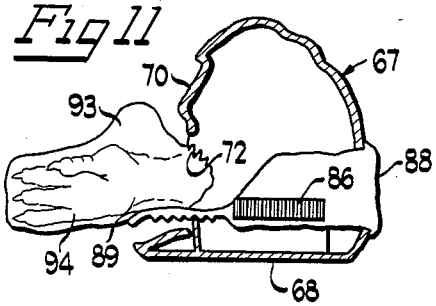
FIG. 11 is a sectional view taken generally along line 11—11 of FIG. 10.

As illustrated in FIGS. 6–8, when the arm ledges 74 and 75 are in their overlapping closed position they obscure the monster face 70. The outer surfaces 90 and 91 of the shoulder ledges 74 and 75, respectively, that are exposed when the shoulder ledges are in the overlapping closed position, along with the exposed surfaces of the base 67 and rim 88 of the actuator 85 all have a rocklike appearance and texture. Inner surfaces 92 and 93 of the respective shoulder ledges 74 and 75 may be provided with an appearance and texture simulating the monster's arms that would be compatible with the face 70. It is also possible to provide the outside of the armlike ledges 74 and 75 with a subtle suggestion of a monster's arm or hand such as 94 as illustrated in FIG. 11 while still maintaining the overall and more predominant rocklike appearance and texture. When the arms are closed together by rearward movement of the actuator they tend to pull a character such as 60 into mouth 72 if the character is positioned generally in front of the mouth within the grasp of the arm ledges.

Another alternative of the present invention is shown in a monster rock creature 95 illustrated in FIGS. 12–15. A hollow base 97 has a substantially flat bottom 98. Mounted for pivotal movement up and away from the base, about a shaft 100 journaled in the base, is a jutting jaw piece 102. At the back lower end of jaw piece 102 adjacent the pivotal mount on shaft 100 is a gear segment 104 that extends down into hollow base 97.

Extending out the back of the base is an actuator lever 105 that is carried for sliding movement into and out of the base. A pair of pins 106, extending up from the base through a slot 107 in the lever, retain and guide the sliding movement of lever 105. On the upper surface or edge of lever 105 there is a rack 108 that engages the gear segment 104 to rotate jaw piece 102 up and away from the base as lever 105 is pushed into the base. Pushing the raised jaw back down towards the base drives the rack back sliding out lever 105. Conversely, pulling the lever back out will return the jaw piece to the at rest position illustrated in FIGS. 13 and 14. Adjacent the forward end, sliding lever 105 has an upwardly projecting trigger 109.

Forward of the pivotal mount to the base, jaw piece 102 extends generally horizontally when it is at rest and has a generally flat, upwardly facing lip surface 112. Between the back mounted end and lip 112, the lower part 113 of a fanged mouth is formed. Rearward of the back wall 114 of the lower part of the mouth is an upwardly projecting reed 116. Generally disposed above the reed is a rod 118. Mounted for pivotal movement about rod 118 is an upper jaw/head 120. The bottom surface of jaw 120 forms the upper part 122 of the fanged mouth. Along the curved outside rear surface of piece 120 there is a gear segment 124. A spring 126 secured to the rod 118 biases jaw/head piece 120 up and away from the lower jaw piece 112. As the upper jaw/head springs open, the teeth on gear segment 124 engage the reed 116 creating a rapid ratcheting or clicking sound.

Figure 14:
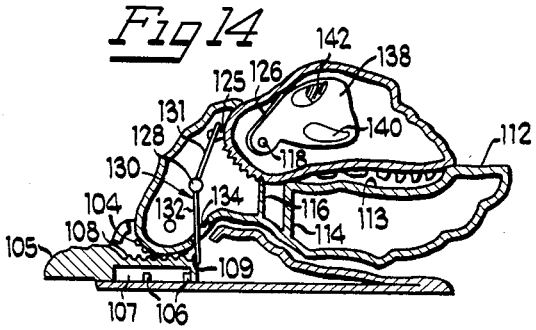
FIG. 14 is a sectional view taken generally along line 14—14 of FIG. 12.
Figure 15:
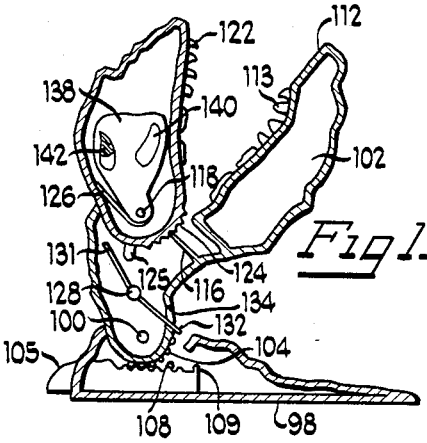
FIG. 15 is a sectional taken along a line similar to line 14—14 of FIG. 12 with the alternative embodiment of FIG. 12 actuated.
Figure 12:
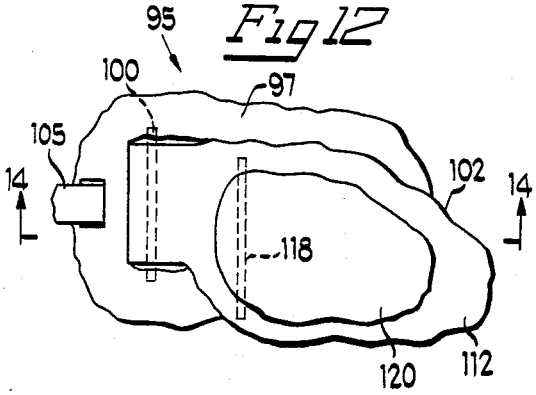
FIG. 12 is a top plan view of another alternative embodiment of the present invention.
Figure 16:
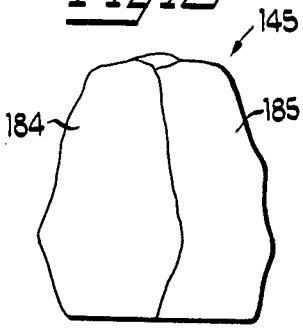
FIG. 16 is a front elevational view of yet another alternative embodiment of the present invention.
Figure 17:
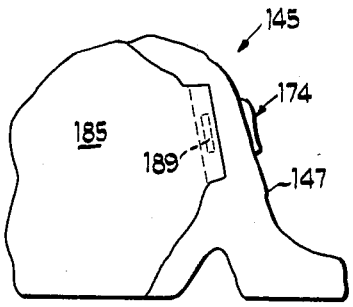
FIG. 17 is a side elevational view of the alternative embodiment shown in FIG. 16.
Figure 21:
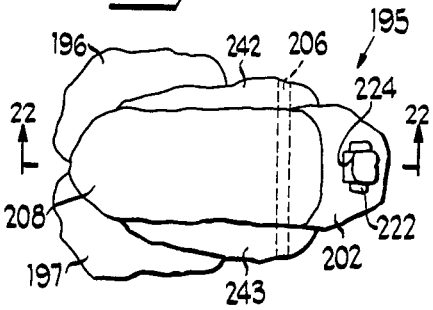
FIG. 21 is a top plan view of yet another alternative embodiment of the present invention.
Figure 18:
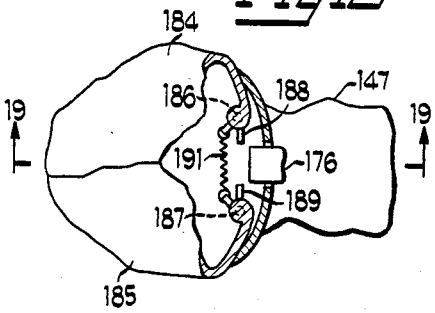
FIG. 18 is a top plan view, partially broken away, of the alternative embodiment shown in FIG. 16.
Figure 22:
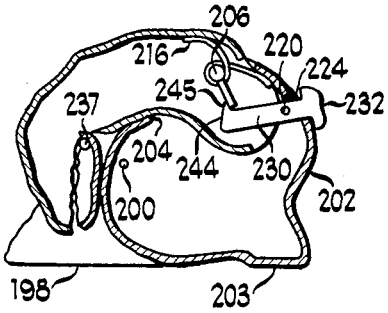
FIG. 22 is a sectional view taken along line 22—22 of FIG. 21.

Above the teeth of the gear segment there is an outwardly projecting tab 125. In the rearward part of piece 102, about a pin 128 secured to the inner sidewalls of piece 102, a sear 130 is mounted for pivotal movement between a latching position and a release position. In the latching position, the upper end 131 of the sear abuts the tab 125 preventing the biased pivotal movement of piece 120. At its lower end 132, the sear extends through a slot 134 in the bottom wall of piece 102. The length of the slot 134 limits the pivotal movement of sear 130 between the latching and releasing positions. As actuator 105 is pushed inwardly, its trigger end 109 engages the lower end 132 of the sear and pivots it in a counterclockwise position, as the sear is illustrated in FIGS. 14 and 15, to move the upper end 131 out of latching engagement with tab 125. When the upper piece 120 and the jaw piece 102 are pushed back down, the sear rotates under the bias of gravity back into latching engagement with tab 125.

Figure 13:
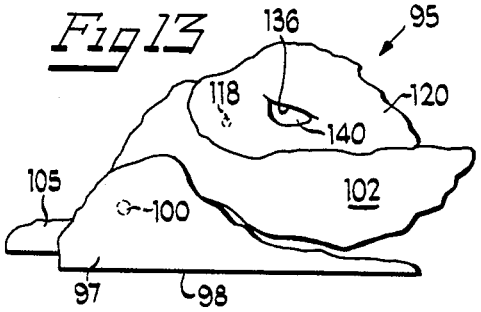
FIG. 13 is a side elevational view of the alternative embodiment shown in FIG. 12.
Figure 10:
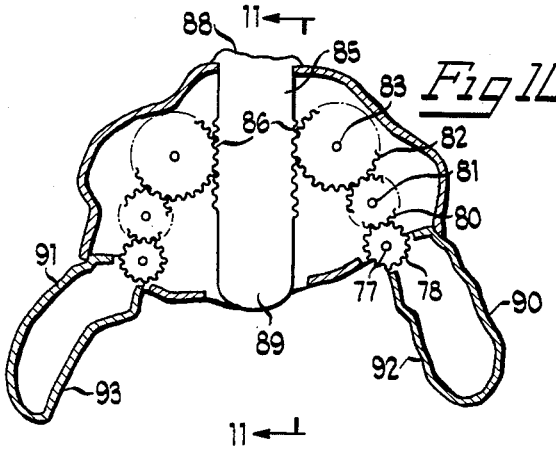
FIG. 10 is a sectional view taken generally along line 10—10 of FIG. 9.

In play, a character such as 60 may be positioned on the flat lip 112. As the lever 105 is first pushed in, the upper jaw/head piece 120 will quickly pivot open under the spring 126 and the jaw 102 will start moving up and away from the base. At the forward limit of sliding actuator 105 the intermediate lower jaw piece 112 will have been raised to the position illustrated in FIG. 15 and the character 60 will have toppled into the open fanged mouth formed by parts 112 and 122. When the pieces are all closed together as illustrated in FIGS. 13 and 14, their exposed surfaces all have a rocklike appearance and texture.

Upper jaw/head 120 has a hole 136 in each side. Secured on rod 118 is a roughly triangularly shaped plate 138 with a rock eye 140 and a spaced apart monster eye 142. Plate 138 is stationary with respect to lower jutting jaw piece 102. In the quiescent state, rock eye 140 is exposed through hole 136. However, after piece 120 springs away from lower jaw piece 102, monster eye 142 is exposed.

In FIGS. 16–20 there is shown yet another alternative of the present invention embodied in a monster rock 145 having a base 147 with a substantially flat bottom 148. Base 147 also has a flat surface 149 at an angle to the flat surface 148. The angled flat surface 149 which is roughly at an angle of one hundred and forty-five degrees to the generally flat bottom 148 permits the monster rock 145 to be tilted forward in a position facilitating the picking up of characters such as 60 resting upon the playing surface. On the underside of an upper, laterally projecting, portion 150 of the base, there is formed an upper part 152 of a fanged mouth. Mounted for pivotal movement about a shaft 154 that is secured between inside walls of base 147 is a lower jaw piece 156. The upper surface of piece 156 provides the lower portion 158 of an open fanged mouth.

Figure 19:
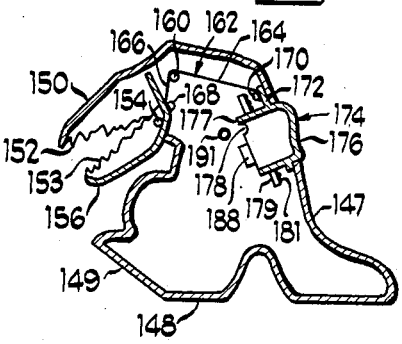
FIG. 19 is a sectional view taken generally along line 19—19 of FIG. 18.
Figure 23:
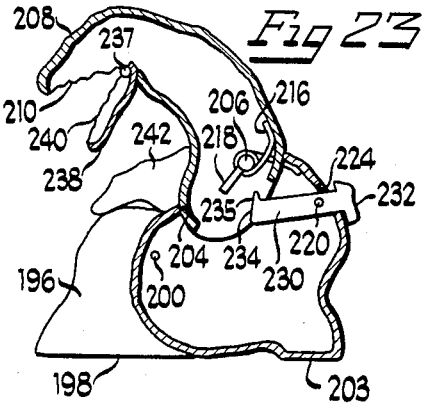
FIG. 23 is a sectional view taken along a line similar to line 22—22 that shows the alternative embodiment of FIG. 21 actuated.
Figure 20:
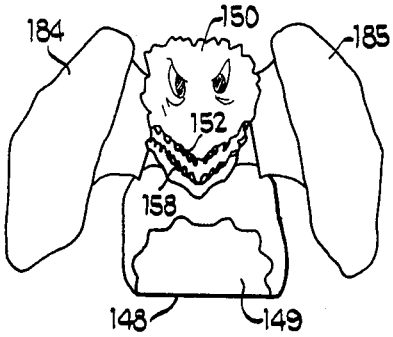
FIG. 20 is a front elevational view of the alternative embodiment of FIG. 16 when actuated.
Figure 24:
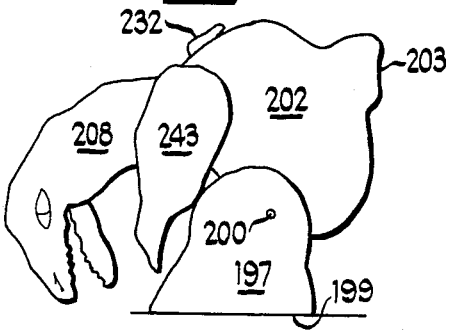
FIG. 24 is a side elevational view of the alternative embodiment of FIG. 21 when partially actuated.

Spaced from, and substantially parallel to, shaft 154 is a rod 160 which may be integrally formed as part of hollow base 147, particularly if the base is made of mating halves. Mounted for pivotal movement about rod 160 is a generally L-shaped, resilient link 162. As is shown in FIG. 19, link 162 is mounted for pivotal movement about rod 160 at the inside of the intersection between its long leg 164 and its short leg 166. At its free end, leg 166 is secured to the backside of lower jaw member 156 by attachment to an integrally formed boss 168 or other suitable fastening methods. Similarly, the free end of long leg 164 is secured to the inner surface 170 of a flange 172 on an actuator button 174. The actuator has an exposed surface 176 for pushing with a finger or thumb and an opposed inside edge 177 with an indentation 178.

Within base 147 there is a guide track 179 attached to the insides of base 147 that is generally parallel to flange 172 of actuator button 174. When the actuator is pushed inwardly flange 172 abuts guide track 179 the outboard surface of which is provided with serrations 181. With flange 172 in contact with guide track 179, outer surface 176 of the actuator button is just inside base piece 147. Accordingly, actuator 174 may be reciprocated toward the top and bottom with flange 172 in contact with guide track 179. Link 162 is sufficiently resilient to accommodate the inward movement of actuator 174 but is also sufficiently rigid to transmit the rocking of the link about rod 160 to cause lower jaw 156 to pivot toward and away from portion 150 of the base. Reciprocation of actuator 174 along serrations 181 produces a clicking or ratcheting sound as the jaw moves.

Also mounted for pivotal movement with respect to base 47 are a pair of winglike pieces 184 and 185. The pivotal axes 186 and 187 of the pieces 184 and 185 converge toward each other in a plane that is on an angle with respect to the axis of shaft 154. Inward of the respective axes, pieces 184 and 185 have respective tabs 188 and 189 extending toward the center of the inside of base 147. Forward of the pivotal axes a compression spring 191 extends across the inside of base 147 biasing the winglike pieces 184 and 185 away from each other. When actuator 174 is pushed inwardly, its forward edge 177 engages both of the tabs to pivot the wings away from each other. Indentation 178 accommodates compression spring 191, the bias of which assists in opening the wings to the position shown in FIG. 20.

Still another alternative of the present invention is shown embodied in a monster rock 195 illustrated in FIGS. 21–24. Monster rock 195 has a pair of spaced apart bases 196 and 197 each of which has a substantially flat bottom 198 and 199, respectively. Mounted for pivotal movement with respect to the spaced apart bases about a pin 200 is a generally hollow body boulder 202 having a flat bottom portion 203. At the top, boulder 202 has a front to back central opening 204. On a shaft 206 journaled between, and extending beyond, the inside walls of boulder 202 is a head outcropping 208. The forwardmost part of outcropping 208 has the upper portion of a fanged mouth 210 formed on the underside. Opening 204 in the top of boulder piece 202 receives the rearward part of outcropping 208 which is so formed as to close the opening in both the quiescent position shown in FIG. 22 and the aggressive monster position shown in FIG. 23. A flat spring 216 wrapped around the shaft 206 and bearing against the inside of outcropping 208 and an inside surface of boulder piece 202 biases outcropping 208 to the raised aggressive position shown in FIG. 23.

Shaft 206 has a pawl 218 that rotates with the shaft. A fulcrum pin 220 is journaled between inwardly depending bosses 222 integrally formed as part of boulder piece 202 on either side of a slot 224. Mounted on fulcrum pin 220 is a trigger 230. An enlarged end 232 of the trigger is exposed on the outside of the boulder piece. At its forward end, trigger 230 has an angled cam front edge 234 and a catch 235. With the outcropping in the lowered position, pawl 218 engages catch 235 to latch the outcropping against the bias of spring 216 and retain outcropping 208 in the quiescent position. Pushing upwardly on the exposed surface 232 pivots the trigger about pin 220 moving the catch down out of engagement allowing the outcropping to spring up to the position shown in FIG. 23. Upon release, gravity pivots the heavier enlarged end 232 downwardly, bringing up the catch 235 and front angled cam 234. When the outcropping is pushed back down the pawl rides up the angled cam 234 and is again retained by catch 235.

Pivotably connected about a pin 237 adjacent the upper part of the fanged mouth 210 is a lower jaw 238, the upper surface of which forms the lower fanged mouth portion 240. Lower jaw 238 pivots freely and is biased away from the upper mouth part by gravity when the outcropping 208 is in the raised aggressive position shown in FIG. 23. A pair of arm ledges 242 and 243 are also mounted for free pivotal movement on extending ends of shaft 206. In the quiescent state, the forwardmost or handlike portions of pieces 242 and 243 rest upon base pieces 196 and 197, respectively. The base pieces resemble monster legs although they have a rocklike texture and appearance. Body boulder 202 may be manually pivoted by a child about rod 200 to the position shown in FIG. 24, at which time arm pieces 242 and 243 will move off of the bases 196 and 197 and swing downwardly along with the open mouthed outcropping 218.

While particular embodiments of the present invention have been shown and described, further changes and modifications will occur to those skilled in the art. It is intended in the appended claims to cover all such changes and modifications as fall within the true spirit and scope of the present invention.

What is claimed as new and desired to be secured by Letters Patent is:

1. A toy monster rock comprising:

a hollow base piece having a substantially flat bottom;

at least one other piece mounted for movement with respect to the base piece between a first position and a second position;

all of the exposed surfaces of the base piece and the other piece having a simulated rocklike appearance and texture;

movement of the other piece to the second position exposing a monsterlike face having an open mouth;

an actuator mounted for sliding movement into and out of the substantially hollow base;

the actuator including a gear rack; and gear means engaged by the rack moving the other piece between the first and second positions.

2. The toy monster rock of claim 1 in which the other piece is biased toward the second position.

3. The toy monster rock of claim 1 in which the other piece is mounted for pivotal movement.

4. The toy monster rock of claim 1 in which the one other piece and a second other piece are each mounted for pivotal movement about an axis that is substantially parallel to the other axis.

5. The toy monster rock of claim 4 in which:

the actuator means includes a gear rack mounted for sliding movement into and out of the base piece; and gear means engaged by the rack on the actuator effect pivotal movement of the opposed one and second other pieces toward and away each other.

6. A toy monster rock comprising:

a base piece having a substantially flat bottom;

at least one other piece mounted for movement with respect to the base piece between a first position and a second position;

the other piece being biased toward the second position;

all of the exposed surfaces of the base piece and the other piece having a simulated rocklike appearance and texture;

actuator means for moving the other piece between the first and second positions;

movement of the other piece to the second position exposing a monsterlike face having an open mouth; and disengagable latch means retaining the other piece in the first position in opposition to the bias means.

7. The toy monster rock of claim 6 in which the actuator means includes a trigger for disengaging the latch means.

8. A toy monster rock comprising:

a base piece having a substantially falt bottom;

at least one other piece mounted for movement with respect to the base piece between a first position and a second position;

all of the exposed surfaces of the base piece and the other piece having a simulated rocklike appearance and texture;

actuator means for moving the other piece between the first and second positions;

movement of the other piece to the second position exposing a monsterlike face having an open mouth;

a second piece mounted for pivotal movement with respect to the open mouth;

the second piece having a designated area for placement of an object of a predetermined size; and the actuator also effecting pivotal movement of the second piece to deposit the object in the open mouth.

9. A toy monster rock comprising:

a base piece having a substantially flat bottom;

at least one other piece mounted for movement with respect to the base piece between a first position and a second position;

all of the exposed surfaces of the base piece and the other piece having a simulated rocklike appearance and texture;

actuator means for moving the other piece between the first and second positions;

movement of the other piece to the second position exposing a monsterlike face having an open mouth;

the one other having a portion forming one jaw of the open mouth; and a second piece mounted for pivotal movement with respect to the one other piece and having a portion forming the other jaw.

10. The toy monster rock of claim 9 in which:

the portion of the one other piece forms the upper jaw of the mouth; and the portion of the second piece mounted for pivotal movement with respect to the one piece forms the lower jaw of the open mouth.

* * * * *